United States Patent [19]

Feger et al.

[11] Patent Number: 4,486,156

[45] Date of Patent: Dec. 4, 1984

[54] CONCRETE PUMP WITH BUTTRESSED DISTRIBUTION PIPE

[75] Inventors: Herbert Feger, Ettlingen; Rolf Griesbach, Dortmund; Franz-Hubert Geue, Sundern, all of Fed. Rep. of Germany

[73] Assignee: Maschinenfabrik Walter Scheele GmbH & Co. KG, Unna-Massen, Fed. Rep. of Germany

[21] Appl. No.: 427,180

[22] Filed: Sep. 29, 1982

Related U.S. Application Data

[63] Continuation-in-part of Ser. No. 386,259, Jun. 8, 1982, abandoned.

[30] Foreign Application Priority Data

Jun. 9, 1981 [DE] Fed. Rep. of Germany ..... 3122825

[51] Int. Cl.[3] ..... F04B 15/02

[52] U.S. Cl. ..... 417/517; 417/519; 417/532; 417/900

[58] Field of Search ..... 417/516, 517, 900, 519, 417/532

[56] References Cited

U.S. PATENT DOCUMENTS

| | | | |
|---|---|---|---|
| 3,298,322 | 1/1967 | Sherrod | 417/900 |
| 4,258,612 | 3/1981 | Kuhlmann | 417/900 |
| 4,382,752 | 5/1983 | Schlect | 417/900 |

FOREIGN PATENT DOCUMENTS

| | | | |
|---|---|---|---|
| 24343 | 3/1981 | European Pat. Off. . | |
| 1285319 | 12/1968 | Fed. Rep. of Germany . | |
| 1684288 | 3/1973 | Fed. Rep. of Germany . | |
| 2355528 | 5/1975 | Fed. Rep. of Germany . | |
| 1653607 | 4/1977 | Fed. Rep. of Germany . | |
| 2614895 | 10/1977 | Fed. Rep. of Germany . | |
| 2632816 | 1/1978 | Fed. Rep. of Germany . | |
| 2729159 | 1/1979 | Fed. Rep. of Germany . | |
| 2162406 | 3/1979 | Fed. Rep. of Germany . | |
| 2814845 | 10/1979 | Fed. Rep. of Germany . | |
| 2824047 | 11/1979 | Fed. Rep. of Germany | 417/516 |
| 2903749 | 8/1980 | Fed. Rep. of Germany . | |
| 3045885 | 12/1980 | Fed. Rep. of Germany . | |
| 2931814 | 2/1981 | Fed. Rep. of Germany . | |
| 3118937 | 5/1981 | Fed. Rep. of Germany . | |
| 2359290 | 2/1975 | France . | |
| 2244085 | 4/1975 | France . | |
| 2247628 | 5/1975 | France . | |
| 1585794 | 3/1981 | United Kingdom . | |

OTHER PUBLICATIONS

PCT International Search Report-PCT/DE80/00011, 8/7/80.

*Primary Examiner*—Richard E. Gluck
*Assistant Examiner*—Peter M. Cuomo
*Attorney, Agent, or Firm*—Montague & Ross

[57] ABSTRACT

A pump assembly has a hopper adapted to hold a wet concrete mass and having a front wall formed with a front port centered on a front axis perpendicular to the front wall at the front port and a rear wall formed with two rear ports centered on respective rear axes perpendicular to the rear wall at the rear ports and generally parallel to the front axis. Respective piston pumps secured to the rear wall outside the hopper over the rear ports are operable to draw portions of the mass out of the hopper and expel them back into the hopper through the respective rear ports. An outlet conduit is connected to the front wall outside the hopper over the front port and a distributor pipe in the hopper has a front end fitted and aligned with the front port and a rear end engageable over and alignable with either of the rear ports. A buttress formation fixed on front end of the distributor pipe defines outside the hopper a buttress plane parallel to the front and rear planes. An abutment lying on the buttress plane engages the buttress formation. A drive oscillates the distributor pipe about the front axis between one position with the rear end aligned with and engaged over one of the rear ports and with the other rear port opening into the hopper and another position with the rear end aligned with and engaged over the other rear port and with the one rear port opening into the hopper. The buttress formation and abutment remain in contact with each other but move relative to each other parallel to the planes as the pipe moves between the positions. Tie rods anchored in the abutment and in the rear wall prevent forward movement of the pipe and thereby press the rear end against the rear wall.

8 Claims, 3 Drawing Figures

CONCRETE PUMP WITH BUTTRESSED DISTRIBUTION PIPE

CROSS REFERENCE TO RELATED APPLICATIONS

This application is a continuation-in-part of copending application Ser. No. 386,259 filed June 8, 1982 (now abandoned). This application is also related to copending applications Ser. No. 326,893 filed Dec. 2, 1981 (now U.S. Pat. No. 4,431,286 and Ser. Nos. 386,258 and 386,260 (now abandoned), both filed June 8, 1982.

FIELD OF THE INVENTION

The present invention relates to a pump assembly for a highly viscous fluid. More particularly this invention concerns a concrete pump.

BACKGROUND OF THE INVENTION

The above-identified patent applications describe a standard concrete pump having a hopper adapted to hold the viscous concrete mass and having a front wall formed with a front port at a front axis perpendicular to the front wall at the front port and a rear wall formed with two rear ports centered on respective rear axes perpendicular to the rear wall at the rear ports and generally parallel to the front axis. Respective piston pumps secured to the rear wall outside the hopper over the rear ports can draw portions of the mass out of the hopper and expel the drawn-out portions back into the hopper through the respective rear ports. An outlet conduit is connected to the front wall outside the hopper over the front port.

A nonstraight distributor pipe in the hopper has a front end engaged over and aligned with the front port and a rear end engageable over and alignable with either of the rear ports. The distributor pipe can be pivoted about the front axis between one position with the rear end aligned with and engaged over one of the rear ports and with the other rear port opening into the hopper and another position with the rear end aligned with and engaged over the other rear port and with the one rear port exposed in the hopper.

The hopper is filled with concrete and the pumps are operated alternately, with the one pump expelling concrete into the distributor pipe while the other, whose rear port is exposed in the hopper, draws in a portion. Thus a virtually continuous flow, interrupted only momentarily as the distributor pipe moves between its end positions, is produced in the distributor pipe and outlet conduit connected to it. It is possible in this manner to displace concrete which is an extremely heavy, abrasive, viscous, and corrosive material that either could not be displaced by any conventional pump or that would quickly destroy it.

In order to minimize wear in the distributor pipe, whose ends lie on parallel planes centered on axes that are perpendicular to these planes and offset thereon from each other, this element is S-shaped. Thus losses are minimized as the concrete changes direction in the pipe and the two ends of the distributor pipe are centered on their respective parallel axes. This S-shape may be formed of a succession of straight sections as described in German patent document No. 1,285,319 filed Aug. 8, 1960 by F. W. Schwing, or it may be gently curved as described in German patent document No. 1,653,607 filed by E. L. Sherrod with a claim to the priority of his U.S. application Ser. No. 524,675 filed Feb. 3, 1966.

The distributor pipe can be generally curved and have a generally arcuate centerline crossing the front axis at the front port and extending parallel to the rear axis at the rear wall. This pipe can be wholly curved between its front and rear ends with the centerline smoothly arcuate or it can be formed of two straight portions joined at an elbow. This is made possible by having the outlet pipe extending away from the front wall at an angle, that is with its centerline coaxial with the front end of the front section of the distributor pipe when midway between its positions. The front end of the distributor pipe normally projects axially into a seat so that sealing the joint at this location is easy, and it similarly is no problem to protect the joint from abrasion by the concrete as the distributor pipe oscillates about the front axis. The rear end, however, rides in an arcuate guide slot, engaging backward against a valve plate formed with two holes constituting the rear port. A tight joint is needed here to prevent loss of pumping pressure and to avoid driving water out of the pumped mass.

To this end the distributor pipe is urged backward against the valve plate forming the rear ports, or this valve plate is urged axially forward against the rear end of the distributor pipe. This valve-plate biasing can be effected by springs, or hydraulic cylinders can be employed to allow periodic axial advance of the valve plate as it wears and/or to maintain sufficient pressure to prevent leakage.

German patent document No. 2,162,406 filed Dec. 16, 1971 by K. Schlecht describes a system wherein a C-shaped distributor pipe with both of its ends pointing backwardly is urged axially with a continuous pressure both against the intake ports at the pumps and at the output port. To this end the C-shaped pipe carries a shoe that rides on a traverse provided in the hopper and urged continuously back by an arrangement outside the hopper and connected to the traverse by tie rods that extend through the rear wall into the hopper. In such an arrangement the force is exerted continuously. In addition concrete is constantly present between the shoe carried on the distributor pipe and the traverse-guide on which this shoe rides, so the system is subject to enormous wear.

OBJECTS OF THE INVENTION

It is therefore an object of the present invention to provide an improved pump assembly.

Another object is the provision of such a pump assembly which overcomes the above-given disadvantages.

SUMMARY OF THE INVENTION

These objects are attained according to the instant invention in a pump assembly for moving a viscous mass which has a hopper adapted to hold the mass and having a front wall formed with a front port centered on a front axis perpendicular to the front wall at the front port and a rear wall formed with two rear ports centered on respective rear axes perpendicular to the rear wall at the rear ports and generally parallel to the front axis. Respective piston pumps secured to the rear wall outside the hopper over the rear ports are operable to draw portions of the mass out of the hopper and expel the drawn-out portions back into the hopper through the respective rear ports. An outlet conduit is connected to the front wall outside the hopper over the front port and a distributor pipe in the hopper has a front end fitted and aligned with the front port and a rear end engageable over and alignable with either of the rear ports. This distributor pipe is limitedly axially displaceable in the hopper. A buttress formation fixed on the distributor pipe below the front end defines outside the hopper a buttress plane parallel to the front and rear planes. An abutment lying on the buttress plane engages the buttress formation. Drive means oscillates the distributor pipe about the front axis between one position with the rear end aligned with and engaged over one of the rear ports and with the other rear port opening into the hopper and another position with the rear end aligned with and engaged over the other rear port and with the one rear port opening into the hopper. The buttress formation and abutment remain in contact with each other but move relative to each other parallel to the planes as the pipe moves between the positions. Biasing means operatively engaged between the abutment and the rear wall urges the pipe axially backward, here intended to mean preventing it from moving axially forward, and thereby presses the rear end against the rear wall.

This system therefore resists the considerable axially forwardly directed force exerted by the pistons. Lifting of the rear end of the distributor pipe off the rear port through which it is being filled is largely eliminated, so that leakage at this joint is no problem.

According to this invention the pump assembly has axially extending tension elements outside the hopper and having rear element ends anchored in the rear wall and front element ends anchored in the abutment. These elements can easily be dimensioned to resist very large axial forces.

The buttress formation according to this invention is unitary with the front end of the pipe. This can be done by forming the buttress formation as an integral extension of the cast-iron flange of the front end. Thus the subassembly is very rigid.

Normally the abutment is a bar extending between the front ends of the tension elements and having a planar abutment face directed at and operatively engaged with the buttress formation. The abutment face is parallel to the planes and the abutment has a slide block bearing on the face and carried on the buttress formation. In addition to prevent canting of the pipe relative to the axis, the buttress formation bears on the abutment at a location axially in line with the rear end of the pipe.

According to another feature of this invention the rear wall is formed with a stiffening plate in which the tension elements are anchored and the abutment is a plate. The elements are tie rods having threaded ends passing through one of the plates and having shoulders operatively bearing thereon. The tension elements include nuts engaged over the threaded and bearing toward the respective shoulder on the one plate. According to this invention laterally removable shims are provided between the shoulders and the one plate. Thus it is relatively easy to adjust the system to compensate for wear, normally in a valve plate on which the rear end of the pipe bears and which defines the rear ports. These shims can be inserted under the nuts or removed from between the one plate and the respective shoulders to adjust for such wear.

The outlet pipe and the front end of the pipe have interfitting flanges meeting generally at the front plane and centered on the front axis. This joint can be made tight relatively easily, simply by a good planar fit.

DESCRIPTION OF THE DRAWING

The above and other features and advantages will become more readily apparent from the following, reference being made to the accompanying drawing in which.

SPECIFIC DESCRIPTION

Figure 1:
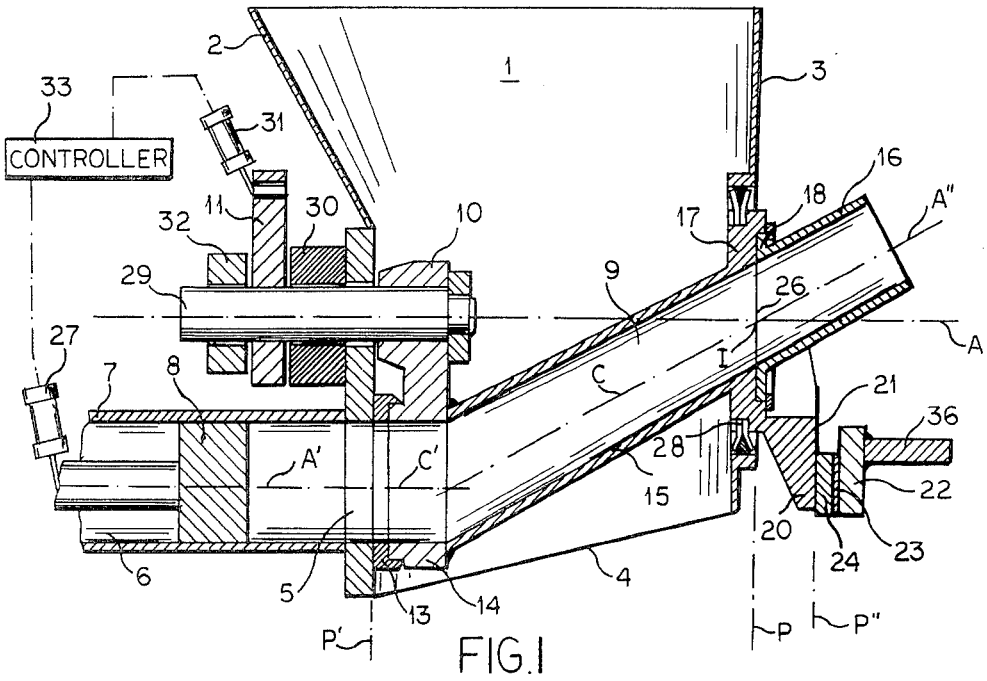
FIG. 1 is a partly schematic axial section through the pump assembly of this invention.
Figure 2:
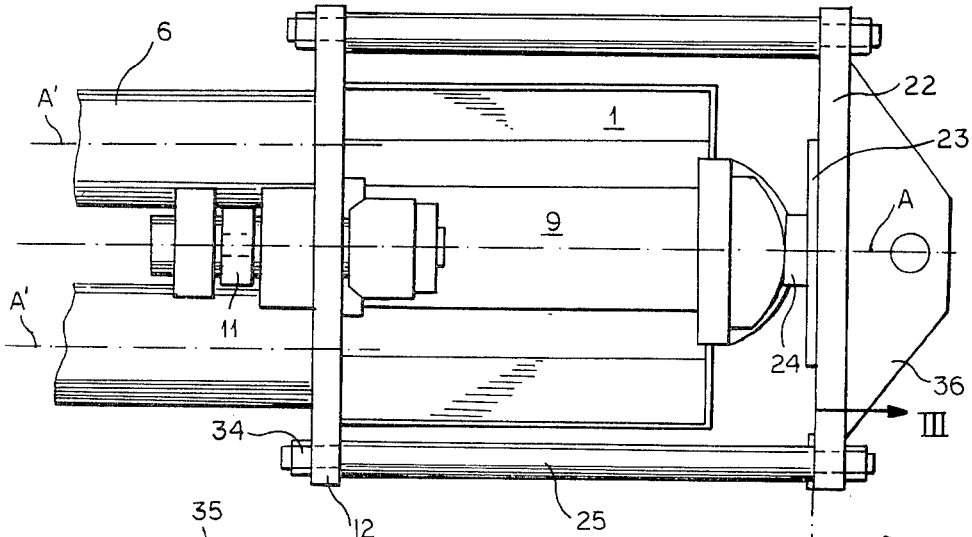
FIG. 2 is a bottom view of the assembly of FIG. 1.
Figure 3:
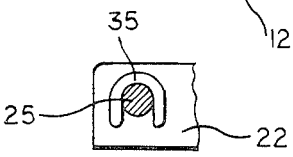
FIG. 3 is a section taken along line III—III of FIG. 2.

As seen in FIG. 1, the system according to this invention has a hopper 1 with a rear wall 2 whose upper portion is inclined and whose lower portion is perfectly vertical, a perfectly vertical front wall 3, and a bottom 4 which may be open. The front wall 3 is formed at a horizontal axis A with a front port 26 and the rear wall 2 is formed with two rear ports 5 centered on respective axes A′ parallel to and equispaced from the axis A. Each of these rear ports 5 is provided with a respective cylinder unit 6 having a cylinder 7 containing a piston 8 reciprocal along the respective axis A′ by means of a respective double-acting hydraulic cylinder 27. The rear wall 2 is provided with a replaceable and wear-resistant valve plate 13 over the ports 5 and formed with thoughgoing holes at these ports.

A distributor pipe 9 extends between the rear and front walls 2 and 3. It has a straight and cylindrical front part 15 centered on an axis or centerline C that intersects the front axis A at I at an upright front plane P perpendicular to the axes A and A′. The rear end 14 of this pipe 9 is actually part of a carrying and actuating arm 10 and has a centerline C′ that intersects the centerline C at an angle of about 150° and that can be positioned coaxial to either of the axes A′, intersecting same on a rear plane P′ at the rear ports 5.

The front end of the pipe 9, toward the right in the drawing, fits and opens at the plane P into an upwardly inclined outlet pipe 16 centered on an axis A″ and of identical cylindrical inside size as the pipe 9. The outlet pipe 16 has an outwardly flanged rear end 18 that in fact forms the front port 26 and fits snugly but rotatably with a flange 17 formed on the front portion 15 of the pipe 9 and riding in a seal 28 in the front wall 3. The straight front portion of the pipe 9 and the outlet pipe 16 form smooth continuations of each other and the centerline C and axis A″ are coaxial when the centerline C′ is equidistant between the axes A′. The rear end of the outlet pipe 16 forms in fact the front port 26.

According to this invention the massive casting that forms the front end 17 of the pipe 9 has a forwardly projecting buttress formation or collar 20 having a planar face 21 that is perpendicular to and traversed by the centerline C′ of the section 14 of the pipe 9. This face 21 defines another plane P″ parallel to and ahead of the plane P and bears via a friction-reducing shoe 24 on a parallel flat face 23 of an abutment bar 22 having a reinforcing flange 36. Tie rods 25 parallel to the axes A and A′ extend backwardly from this abutment 22 to a plate 12 carrying the front ends of the cylinders 7 and in fact constituting an integral part of the lower portion of the rear wall 2. The ends of the tie rods 25 pass through the plate 12 and bar 22 and are provided with nuts 34 engaging axially against them, with shims 35 being provided if desired between the face 23 or the confronting face of the plate 12, and the respective tie-rod end. Thus the tie rods 25 establish a fixed axial spacing between the surface 23 and the planes P and P', and by engagement with the buttress formation 20 make it impossible for the rigid pipe 9 to push forward away from the rear wall 2.

A stub shaft 29 is rotatable in a journal 30 fixed to the rear wall 2 to rotate about the horizontal axis A. This axis A intersects the axis A" and centerline C at I on the plane P of the front port 26. The shaft 29 has an inner end fixed to the end of the arm 10 holding the extreme rear end of the pipe 9 itself and a wear ring if desired. The arm 10 is split so that it can be fitted around the rear end of the pipe 9. The rear or outside end of the shaft 29 is splined to an arm 11 connected to a double-acting hydraulic cylinder 31. A nut 32 is screwed over the extreme rear end 16 of the shaft 29 to lock this arm 11 against axially rearward motion on it.

A controller 33 is connected to the cylinder 31 for the arm 11 and to the cylinders 27 for the pistons 8. This controller 33 can be of the cam-operated or wholly electronic type and alternately operates the pump cylinders 27 and synchronously oscillates the distributor pipe 9 by means of the cylinder 31. This style of operation is standard and does not need detailed description here. The result is that when one piston 8 has its port 5 exposed it is moving back to suck in a portion of concrete, while the other piston 8 is moving forward to expel its previously drawn-in portion into the rear end of the pipe 9. In this manner substantially continuous flow in the pipes 9 and 16 is achieved.

During such oscillation of the pipe 9 about the axis A it will normally be urged forward with great force each time one of the pistons 8 advances and forces its charge of concrete into the rear end section 14 of the pipe 9.

In prior-art machines this force is enough to push the pipe 9 off the respective port 5, allowing leakage at this point. According to this invention this force is effectively resisted by the pipe 9 which bears in line with the emptying cyinder 7 on the surface 23. The pipe 9 is rigid with the formation 20 so that it is effectively braced by it. Since the point of contact between the surface 21 and surface 23, via the shoe 24, is perfectly aligned with the axis A' the section 14 is aligned with, the pumping force will not tend to cant the pipe 9 in the hopper and will not exert a twisting load on the shaft 29; instead this force will merely steady the pipe 9 during each discharge, making the seal between the complementarily interfitting flanges 17 and 18 very tight.

With this system it is relatively easy to compensate for wear, normally of the valve plate 13. This is done by loosening one nut 34 of each of the rods 25 and either removing one of the U-shaped flat shims or spacers 35 on the other side of the plate 12 or bar 22, or adding one more between the nut 34 and the respective plate 12 or bar 22. The shims 35 are of standard thickness, normally 1.0 mm or 2.0 mm and are removed equally on both sides to compensate evenly for wear. If the shims 35 are used under the nuts 34, the threaded ends of the rods 25 should be quite long to allow for considerable adjustment. If the shims 35 are used between the plate 22 and/or the plate 12 the respective shoulder of the tie rod 25 should be spaced far enough in to allow a long stack of shims to be inserted when a new valve plate 13 is installed, so they can be taken out one-by-one as it wears.

This system therefore allows the enormous forces of the pumps 6 to be resisted without this load being effective on internal bearing surfaces. The contact between the shoe 24 and the surfaces 20 and 23 is outside the hopper 1 so modest lubrication will give it a long service life.

We claim:

1. A pump assembly for moving a viscous mass, said assembly comprising:

a hopper adapted to hold said mass and having a front wall formed with a front port centered on a front axis perpendicular to said front wall at said front port and a rear wall formed with two rear ports centered on respective rear axes perpendicular to said rear wall at said rear ports and generally parallel to said front axis, sad front and rear ports opening at respective parallel front and rear planes substantially perpendicular to said axes;

respective piston pumps secured to said rear wall outside said hopper over said rear ports and operable to draw portions of said mass out of said hopper and expel said drawn-out portions back into said hopper through the respective rear ports;

an outlet conduit connected to said front wall outside said hopper over said front port;

a distributor pipe in said hopper having a front end fitted and aligned with said front port and a rear end engageable over and alignable with either of said rear ports, said distributor pipe being limitedly axially displaceable in said hopper;

a buttress formation integrally formed on said distributor pipe below said front end, projecting forward through said front wall of said hopper, and having outside said hopper a forwardly directed abutment face defining outside said hopper a buttress plane parallel to said front and rear planes;

an abutment lying on said buttress plane and having a backwardly directed abutment face engaging said face of said buttress formation;

drive means for oscillating said distributor pipe about said front axis between one position with said rear end aligned with and engaged over one of said rear ports and with said other rear port opening into said hopper and another position with said rear end aligned with and engaged over said other rear port and with said one rear port opening into said hopper, said faces of said buttress formation and abutment remaining in force-transmitting contact with each other but moving relative to each other parallel to said planes as said pipe moves between said positions, said faces axially engaging one another at a location axially aligned with the rear axis of the rear port said rear end is engaged over; and biasing means including axially extending tension elements outside said hopper and having rear element ends anchored in said rear wall and front element ends anchored in said abutment for urging said pipe axially backward and thereby pressing said rear end against said rear wall.

2. The pump assembly defined in claim 1 wherein said buttress formation is unitary with said front end of said pipe.

3. The pump assembly defined in claim 2 wherein said abutment is a bar extending between said front ends of said tension elements and having the respective abutment face directed at and operatively engaged with said buttress formation.

4. The pump assembly defined in claim 3 wherein said faces are parallel to said planes, said abutment having a slide block bearing on said face and carried on said buttress formation.

5. The pump assembly defined in claim 1 wherein said rear wall is formed with a stiffening plate in which said tension elements are anchored and said abutment is a plate, said elements being tie rods having threaded ends passing through one of said plates and having shoulders operatively bearing thereon, said tension elements including nuts engaged over the respective threaded ends and bearing toward the respective shoulder on said one plate.

6. The pump assembly defined in claim 5, further comprising laterally removable shims between said shoulders and said one plate.

7. The pump assembly defined in claim 1 wherein said outlet pipe and said front end of said pipe have interfitting flanges meeting generally at said front plate and centered on said front axis.

8. The pump assembly defined in claim 7 wherein said buttress formation is an integral extension of said flange of said front end.

* * * * *